US008689807B2

(12) United States Patent
Nagatomo et al.

(10) Patent No.: US 8,689,807 B2
(45) Date of Patent: Apr. 8, 2014

(54) WIG CLIP

(71) Applicant: Svenson Co., Ltd., Tokyo (JP)

(72) Inventors: Takahiro Nagatomo, Tokyo (JP); Shinichi Kasori, Tokyo (JP); Yoshitaro Matsushima, Nagareyama (JP)

(73) Assignee: Svenson Co., Ltd., Tokyo (JP)

( * ) Notice: Subject to any disclaimer, the term of this patent is extended or adjusted under 35 U.S.C. 154(b) by 0 days.

(21) Appl. No.: 13/627,860

(22) Filed: Sep. 26, 2012

(65) Prior Publication Data

US 2013/0233330 A1 Sep. 12, 2013

(30) Foreign Application Priority Data

Mar. 6, 2012 (JP) ..... 2012-048671

(51) Int. Cl.
*A45D 24/38* (2006.01)
*A41G 5/00* (2006.01)

(52) U.S. Cl.
USPC ..... 132/145; 132/53

(58) Field of Classification Search
USPC ..... 132/145, 144, 53–56
See application file for complete search history.

(56) References Cited

U.S. PATENT DOCUMENTS

| | | | | |
|---|---|---|---|---|
| 3,120,852 | A * | 2/1964 | Sawyer | 132/145 |
| 5,137,037 | A * | 8/1992 | Mochizuki | 132/53 |
| 6,298,861 | B1 | 10/2001 | Kageyama et al. | |
| 7,735,495 | B2 * | 6/2010 | Lane et al. | 132/53 |
| 2003/0159705 | A1 * | 8/2003 | Ferguson | 132/201 |
| 2004/0163660 | A1 * | 8/2004 | Kellmann | 132/201 |
| 2005/0115581 | A1 * | 6/2005 | Choi | 132/53 |

FOREIGN PATENT DOCUMENTS

| | | | |
|---|---|---|---|
| JP | Hei 11-001811 | A | 1/1999 |
| JP | 2006-037278 | A | 2/2006 |
| JP | 2011-026737 | A | 2/2011 |
| JP | 2011-149110 | A | 8/2011 |

* cited by examiner

*Primary Examiner* — Rachel Steitz
(74) *Attorney, Agent, or Firm* — Law Office of Katsuhiro Arai

(57) ABSTRACT

A wig clip constituted by a plastic base frame and plastic comb body, wherein such wig clip is characterized in that: the base frame has pins or holes provided on/in the side elements of a rectangular frame member comprising front/rear elements and side elements; the comb body has multiple comb teeth provided at the front of the base, while a tab is provided at the rear of the base via a spring having a void, with holes or pins formed in/on the left side and right side of the base; and the comb body and base frame are axially joined in a rotatable manner and have such relationship that the tab can be engaged with the lock member, so that the positions of the two can be changed between an open state and clipping state.

10 Claims, 8 Drawing Sheets

WIG CLIP

BACKGROUND

1. Field of the Invention

The present invention relates to a wig clip used to fit a wig on the head.

2. Description of the Related Art

Metal clips are normally used for this purpose. Wig clips are used that are constructed with a curved, invertible sheet-shaped base frame made by connecting thin metal plates that have been formed in roughly a C shape and deflected, as well as a comb body positioned in a manner facing the lengthwise direction of the base frame, wherein the comb body and base frame are separated from each other or made to come together by inverting the curved part. Examples include Patent Literature 1 (Japanese Patent Laid-open No. Hei 11-1811) and Patent Literature 2 (Japanese Patent Laid-open No. 2006-37278). An example of a conventional wig clip is shown in FIGS. 7(*a*), 7(*b*), and 7(*c*), which is a wig clip 110 constituted by assembling, through grommets 116, a metal sheet spring 118 and a comb body 115 having metal comb teeth 114 in a manner to be curved and deflected. The construction of the wig clip 110 is such that, when it is inverted in the direction of arrow b as shown in FIG. 7(*c*), the comb teeth 114 and metal sheet spring 118 come together by clipping the user's own hair in between. Multiple sets of this wig clip 110 are attached at edges 120 of a wig as shown in FIG. 8.

Such invertible metal wig clips combining a curved sheet spring and comb teeth are widely used because they are thin and offer excellent effect of clipping the user's own hair and securing the wig together with the user's own hair. Although these clips offer such excellent function, how to address such problems as metal allergy, triggering of metal detectors, etc., is being studied. For example, Patent Literature 3 (Japanese Patent Laid-open No. 2011-149110) proposes a wig stopper made of polyamide imide material, wherein the base and clip part of the wig stopper are integrally formed from a single sheet. Patent Literature 4 (Japanese Patent Laid-open No. 2011-26737) proposes use of titanium alloy that does not readily trigger metal detectors.

However, these proposals fail to ensure sufficient clipping force and development of a non-metal, stable wig clip is eagerly awaited.

Any discussion of problems and solutions involved in the related art has been included in this disclosure solely for the purposes of providing a context for the present invention, and should not be taken as an admission that any or all of the discussion were known at the time the invention was made.

BACKGROUND ART LITERATURES

Patent Literatures

[Patent Literature 1] Japanese Patent Laid-open No. Hei 11-1811

[Patent Literature 2] Japanese Patent Laid-open No. 2006-37278

[Patent Literature 3] Japanese Patent Laid-open No. 2011-149110

[Patent Literature 4] Japanese Patent Laid-open No. 2011-26737

SUMMARY

An object of the present invention is to develop a plastic wig clip undetectable by metal detectors.

The present invention is a wig clip constituted by comb teeth and a base frame made of plastics. The key constitutions of the present invention are as follows:

(1) A wig clip constituted by a plastic base frame and plastic comb body, wherein such wig clip is characterized in that:

the base frame has pins or holes provided on/in the side elements of a rectangular frame member comprising front/rear elements and side elements;

the comb body has multiple comb teeth provided at the front of the base, while a tab is provided at the rear of the base via a spring having a void, with holes or pins formed in/on the left side and right side of the base;

the comb body and base frame are axially joined in a rotatable manner and the positions of the two can be changed between an open state and clipping state using a lock mechanism;

the comb teeth and spring provided on the comb body are bent at the base;

the spring is curved and connected to the tab, while the size of the inner curved space at the curved part is such that it spans across the rear element of the base frame; and the base frame and comb body are locked in a clipping state by operating the tab, and unlocked via opening operation.

(2) A wig clip according to (1), characterized in that the lock mechanism has a step formed on the rear element of the frame member of the base frame and is constituted by engagement of the step with the tab provided on the comb body.

(3) A wig clip according to (1) or (2), characterized in that the front/rear elements of the base frame are gradually curved and the comb body is also curved along the curve of the base frame, with the two members forming a clipping state where both are contacting each other.

(4) A wig clip according to any one of (1) to (3), characterized in that the comb tooth members of the comb body have a projection formed on their top face and/or side face.

(5) A wig clip according to any one of (1) to (4), characterized in that a concave for engagement is formed on the back face of the front element of the base frame, while a projection is formed on the top face of the comb tooth, with the engagement concave engaging with the engagement projection in a clipping state.

(6) A wig clip according to any one of (1) to (5), characterized in that the lock member formed on the rear element of the base frame has an arm curving toward the front inner side, in order to contact the base of the comb body and generate turning resistance when turned toward an open state, thereby functioning to maintain the position in an open state.

(7) A wig clip according to any one of (1) to (6), characterized in that the side element of the base frame is formed in such a way that its rear element side is thick and front element side is thin relative to each other.

(8) A wig clip according to any one of (1) to (7), characterized in that the back face of the front element of the base frame and top face of the comb tooth of the comb body have a textured surface.

(9) A wig clip according to any one of (1) to (8), characterized in that the wig attachment holes are formed in the tab of the comb body and front element of the base frame.

(10) A wig product and hair accessory on which wig clips according to any one of (1) to (9) are attached.

EFFECTS OF THE INVENTION

By an ingenious constitution involving shapes and combination of a comb body and base frame, a plastic wig clip capable of fully demonstrating the clipping force needed by the user to fit a wig on his/her own hair could be achieved. The present invention offers good operability because the wig clip can be opened and closed by operating a tab piece.

The resin clip is light and thus does not create discomfort while worn, and will not stress the roots of hairs even when used frequently, thereby preventing hair loss often associated with hair clips.

The plastic clip proposed by the present invention adopts a "clipping by opening/closing" type structure to ensure an open space of just several millimeters, thereby ensuring simple, quick opening/closing operation. Since a curved spring structure is provided to achieve the locked state, the wig clip can be smoothly opened by unlocking operation that utilizes the restorative force of a spring. The textured surface makes it easier to grip hair. Also, the user can easily identify the operating part due to the roughness of the textured surface felt by fingers.

This plastic wig clip can be easily attached on a wig product, hair accessory, etc., in the open state using a thread.

Since the user can pass through metal detectors wearing a wig, he/she no longer needs to remove the wig against his/her will and the wig user's quality of life (QOL) will improve. The same goes with metal detectors and other metal detecting systems used in airport security checks, entry checks at courts and other important locations, MRI tests conducted at hospitals, etc.

The plastic wig clip proposed by the present invention can also be used by people suffering from metal allergy. It is also useful for those using anticancer drugs because unlike metal clips whose metal bracket is felt as too cold on their sensitive skin, the resin clip does not have the coldness of metal pins. As a result, people using anticancer drugs and suffering from hair loss can use a wig more conveniently. Since the resin clip does not break as easily as its metal counterpart, risks of injury/accident will drop.

In addition, pigment is mixed into the resin to prevent discoloration caused by separation of coating film. Metal clips are associated with the risk of others finding out that the person is using a wig once the coating film separates and metal becomes conspicuous.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

Each of FIGS. 1(*a*), 1(*b*), 1(*c*), 1(*d*), and 1(*e*) illustrates a drawing showing an example of a wig clip conforming to the present invention in an open state.

Each of FIGS. 2(*a*), 2(*b*), 2(*c*), 2(*d*), and 2(*e*) illustrates a drawing showing an example of a wig clip conforming to the present invention in a closed state.

Each of FIGS. 3(*a*), 3(*b*), 3(*c*), 3(*d*), and 3(*e*) illustrates a drawing showing an example of a wig clip conforming to the present invention, specifically an example of its base frame.

Each of FIGS. 4(*a*), 4(*b*), 4(*c*), 4(*d*), and 4(*e*) illustrates a drawing showing an example of a wig clip conforming to the present invention, specifically an example of its comb body.

Figure 1A:
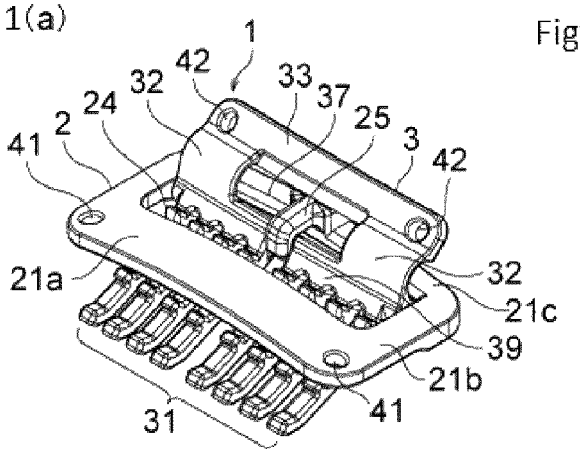
Figure 1B:
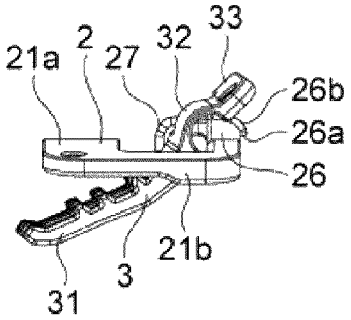
Figure 1C:
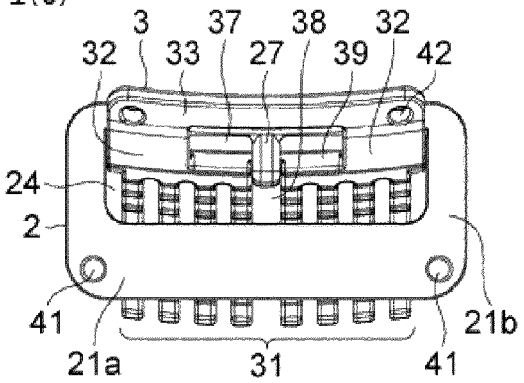
Figure 1D:
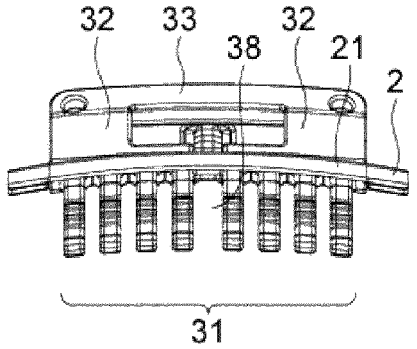
Figure 1E:
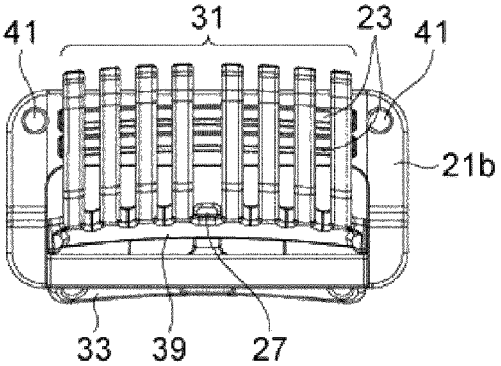
Figure 2A:
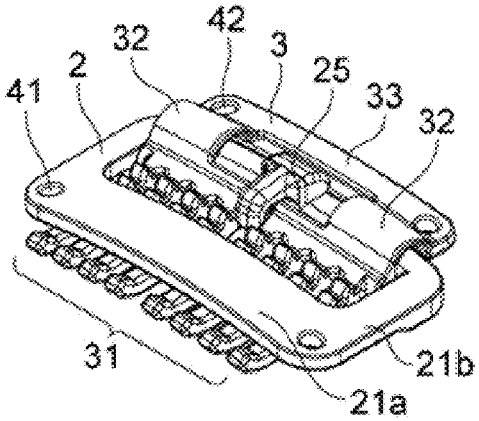
Figure 2B:
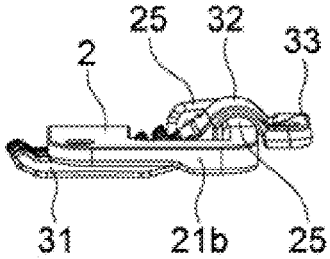
Figure 2C:
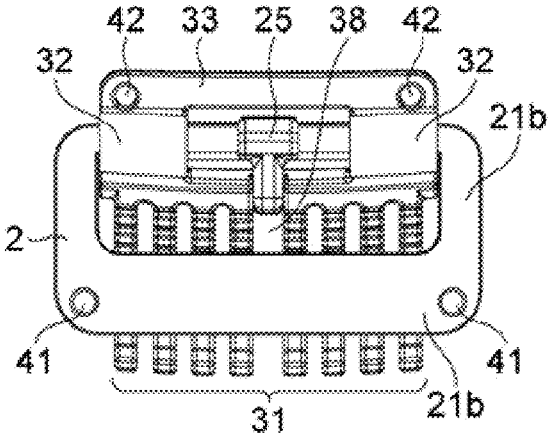
Figure 2D:
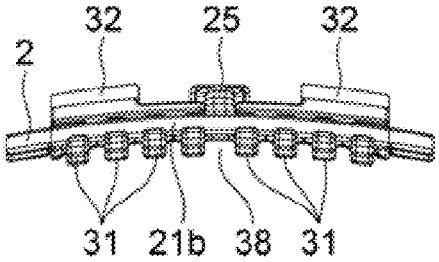
Figure 2E:
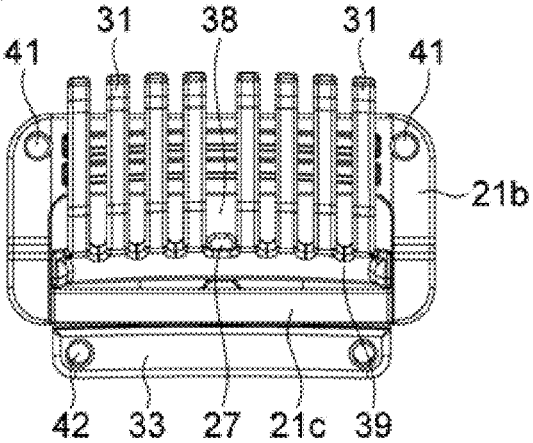
Figure 3A:
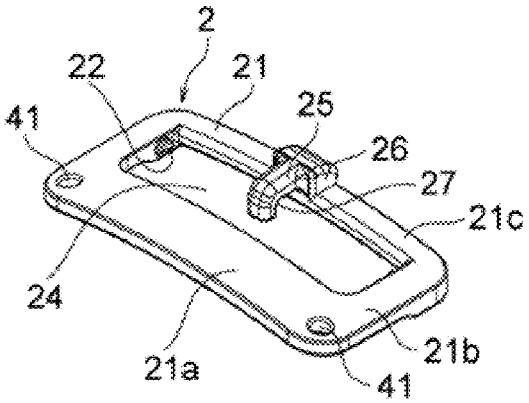
Figure 3B:
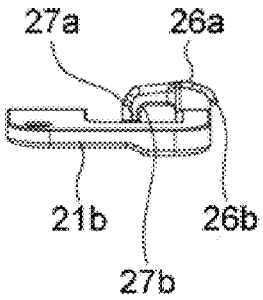
Figure 3C:
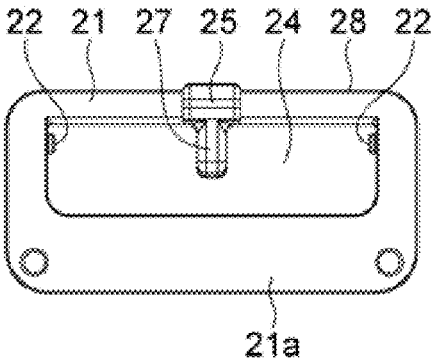
Figure 3D:
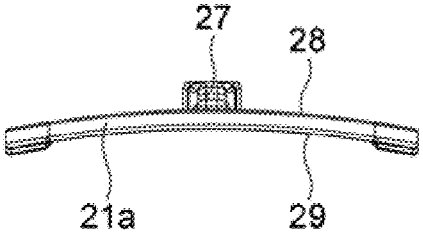
Figure 3E:
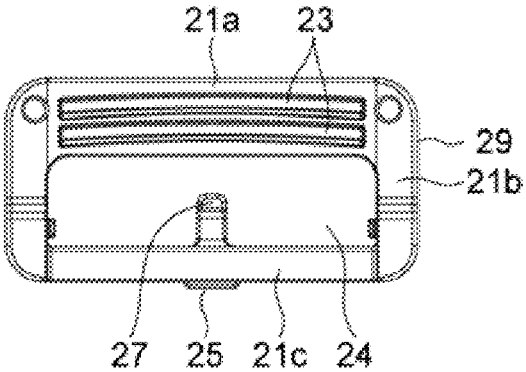
Figure 4A:
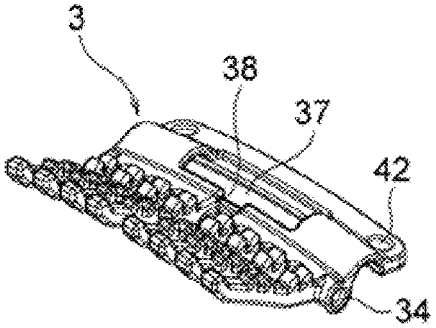
Figure 4B:
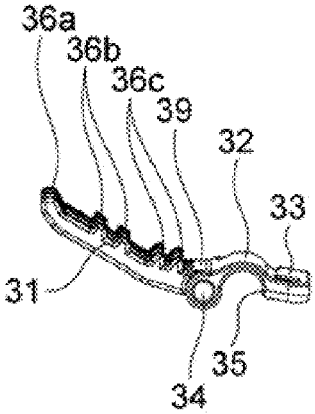
Figure 4C:
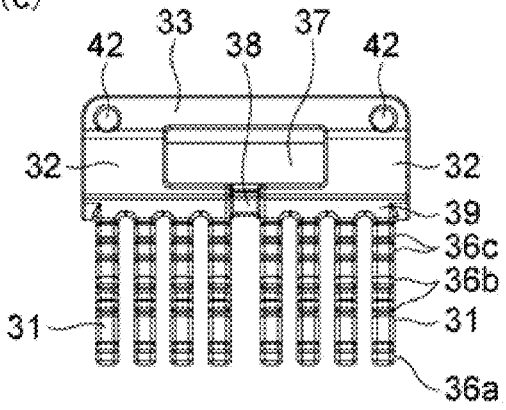
Figure 4D:
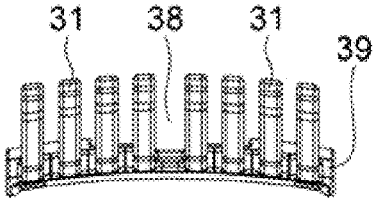
Figure 4E:
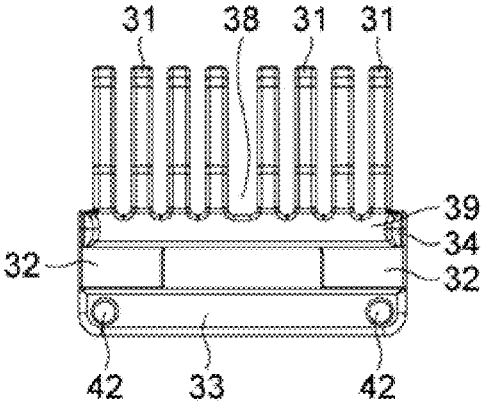
Figure 5A:
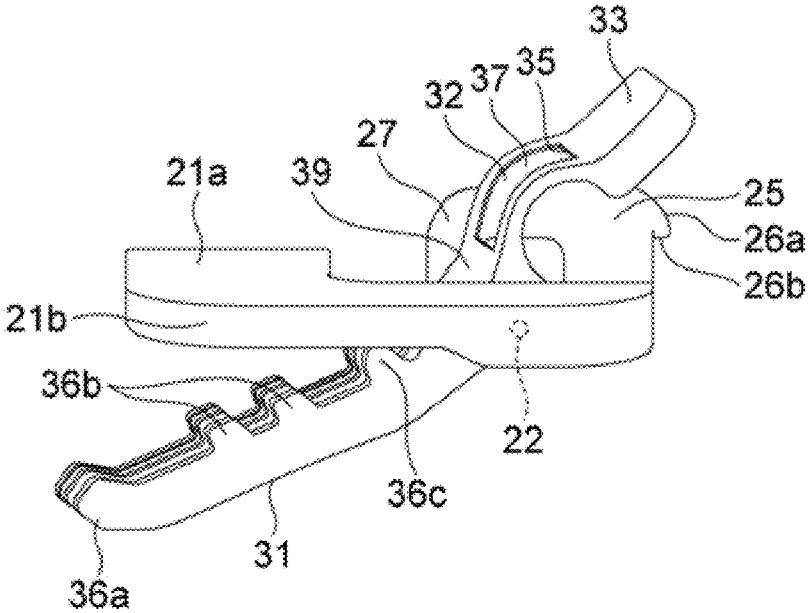
Figure 5B:
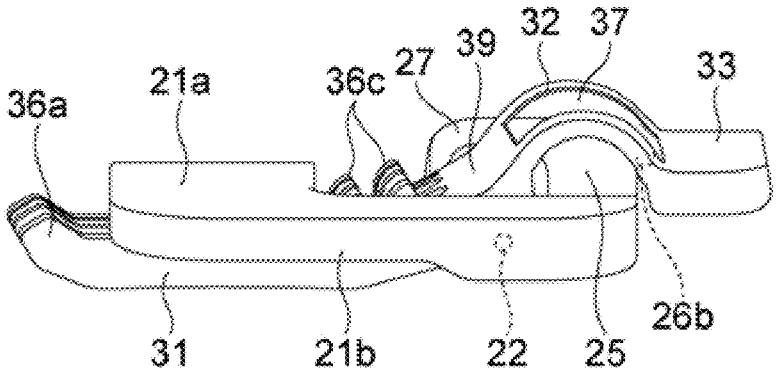

Each of FIGS. 5(*a*) and 5(*b*) illustrates a drawing showing an example of a wig clip conforming to the present invention, specifically how it changes from an open state to a closed state.

Figure 6:
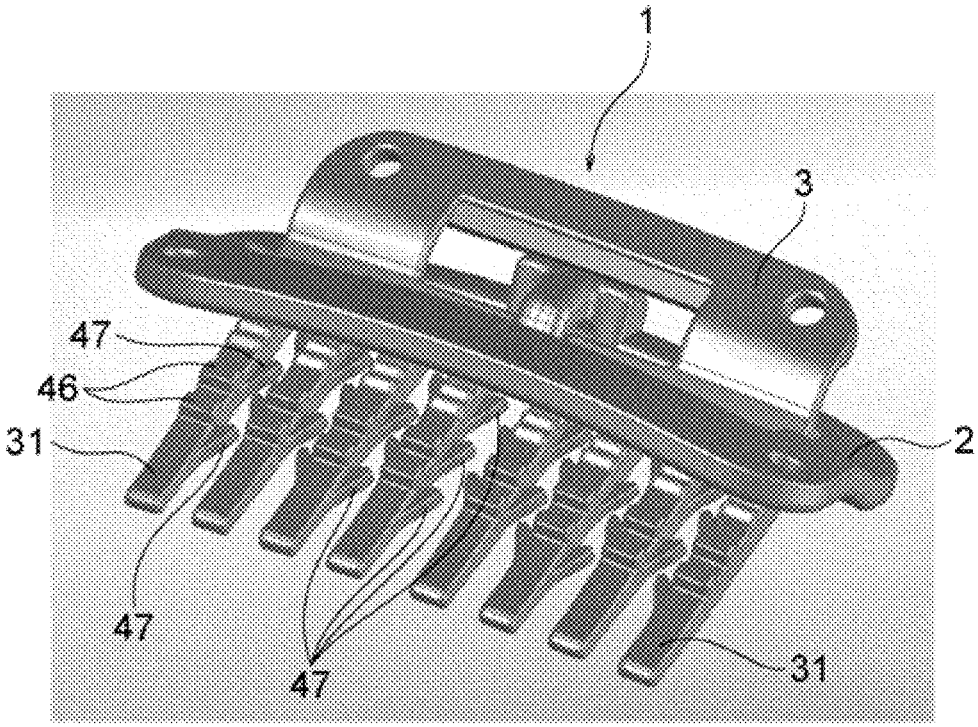

FIG. 6 illustrates a drawing showing an example of a wig clip conforming to the present invention, specifically another example of the projections on comb teeth.

Figure 7A:
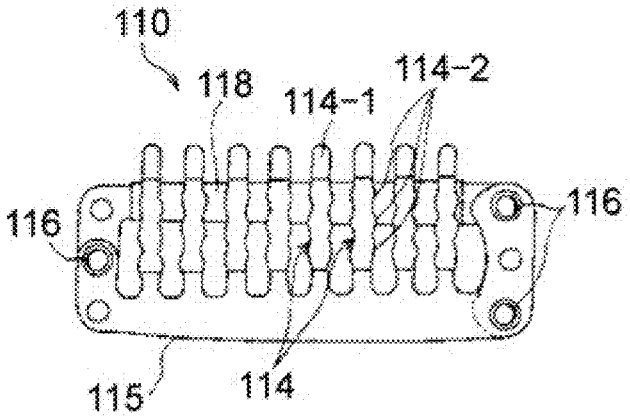
Fig. 7(a) Background Art
Figure 7B:
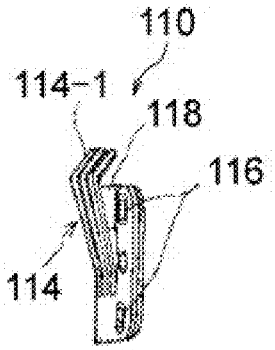
Fig. 7(b) Background Art
Figure 7C:
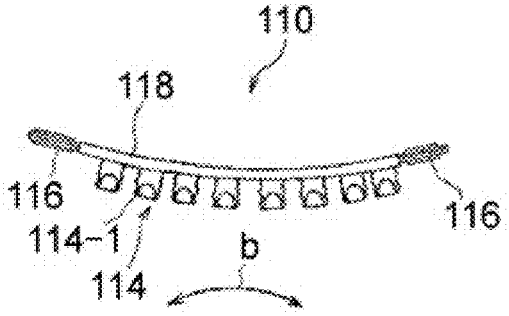
Fig. 7(c) Background Art

Each of FIGS. 7(*a*), 7(*b*), and 7(*c*) illustrates a drawing showing a conventional wig clip of metal inversion type.

Figure 8:
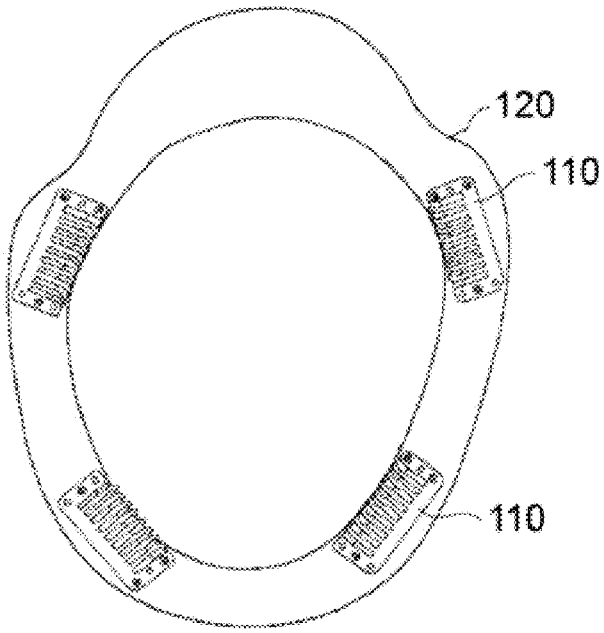

FIG. 8 illustrates a drawing showing wig clips attached at the edges of a wig.

DESCRIPTION OF THE SYMBOLS

1 Wig clip
2 Base frame
21 Frame member
21*a* Front frame element
21*b* Side frame element
21*c* Rear frame element
22 Pin
23 Engagement concave
24 Opening
25 Lock member
26 Base
26*a* Rear curve
26*b* Engagement step
27 Arm
27*a* Arm tip
27*b* Curved part
28 Top face
29 Bottom face
3 Comb body
31 Comb tooth member
32 Curved spring
33 Tab
34 Shaft hole
35 Engagement receiver
36*a* Tip projection
36*b* Center projection
36*c* Base projection
37 Void
38 Cutout
39 Base
41 Hole
42 Hole
46 Vertical projection
47 Lateral projection
110 Wig clip
118 Metal sheet spring
114 Comb tooth
115 Comb body
116 Grommet
120 Edge of a wig

DETAILED DESCRIPTION OF EMBODIMENTS

The wig clip proposed by the present invention is a plastic wig clip. The wig clip was constituted by combining a base frame made of a rectangular frame, with a comb body axially joined to the base frame. It has a lock mechanism that locks the base frame and comb body in a state contacting each other. These wig clips can be attached on a wig, etc., so that the user can put the wig on his/her head and lock the base frame and comb body together by clipping his/her own hair in between, thereby fitting the wig on his/her head.

The side frame elements of the base frame constituted by front/rear and right/left frame bodies are axially joined to the base located at the center of the comb body. The comb body has multiple comb teeth provided at the front of the base, while a tab is provided via a curved spring at the rear. The axially joined comb body has the top faces of its comb teeth contacting the bottom face of the front frame element of the base frame, with the curved part of the spring going over the top face of the rear frame element of the base frame. The shape design is such that, when the comb teeth are contacting the front frame element, the curved part of the spring cannot fully go over the rear frame element. By pushing down the tab and thereby causing the spring to deflect, the tab will move toward the rear frame element and actuate the lock, with the reactive force of the spring now contracting further causes the comb teeth to make strong contact with the front frame element. As a result, this plastic wig clip demonstrates a sufficient clipping force.

The present invention is entirely made of plastic, so its user need not worry about metal detectors. It does not cause allergy or other side effects, either. Since there will not be any broken metal piece that could otherwise damage the head, safety will improve. The lightweight clip generates no discomfort while worn.

This wig clip can be used as a tool to fit a wig or other head accessory on the user's own hair. For instance, the example of conventional clips shown in FIG. 8 also illustrates how the wig clips conforming to the present invention are attached on a wig. By utilizing the wig clip proposed by the present invention, the user no longer needs to take off his/her wig at airports, etc., against his/her will, which improves the QOL of wig users.

The present invention is useful as a clip for fitting a wig, hair extension, hair band, ribbon, bouquet or other head accessory or hair accessory, among others.

For the plastic material, polyacetal resin (POM), polyethylene terephthalate (PET), polyvinyl chloride (PVC), EVAC, polypropylene (PP), AS resin (SAN), ABS resin (ABS), acrylic resin (PMMA), polycarbonate (PC), polyamide (PA), polybuthylene terephthalate (PBT), polytetrafluoroethylene (PTFE), phenol resin (PF), melamine resin (MF), urea resin (UF), PUR, epoxy resin (EP), unsaturated polyester resin (UP), polyethylene (PE), polyether ether ketone (PEEK), ionomer resin (IO), polyvinylidene chloride (PVDC), polyphenylene sulfide (PPS), VF, ALK, VP, PABI, PDAE, etc., can be used. Since it contacts the head and is exposed to sweat and hair care products, plastics resistant to chemicals are suitable.

The wig clip proposed by the present invention is primarily applied to men's wigs. In many cases thinning hair starts from the forehead and progresses toward the top of the head, and the affected area tends to increase over time. The present invention helps provide wigs suitable for this progressing pattern of thinning hair.

An embodiment of the wig clip proposed by the present invention is explained using the drawings primarily based on a wig.

FIGS. 1(*a*), 1(*b*), 1(*c*), 1(*d*), and 1(*e*) show an example of a wig clip in an open state. FIGS. 2(*a*), 2(*b*), 2(*c*), 2(*d*), and 2(*e*) show an example of a wig clip in a closed state with the members contacting each other. FIGS. 3(*a*), 3(*b*), 3(*c*), 3(*d*), and 3(*e*) show an example of a base frame. FIGS. 4(*a*), 4(*b*), 4(*c*), 4(*d*), and 4(*e*) show an example of a comb body. FIGS. 5(*a*) and 5(*b*) show an example of how a wig clip changes from an open state to a closed state. The examples shown in the drawings were manufactured using polyacetal resin (POM).

<Base Frame>

Each of FIGS. 3(*a*), 3(*b*), 3(*c*), 3(*d*), and 3(*e*) shows an example of a base frame 2. FIG. 3(*a*) is a perspective view, FIG. 3(*b*) is a side view, FIG. 3(*c*) is a plan view, FIG. 3(*d*) is a front view, and FIG. 3(*e*) is a rear view.

A base frame 2 comprises a frame member 21 having a front frame element 21*a*, side frame elements 21*b*, 21*b* and a rear frame element 21*c*, with a lock member 25 provided at the center of the rear frame element 21*c* and projecting pins 22 provided at opposing positions of the side frame elements 21*b* on an opening 24 side. The side frame element 21*b* is formed in such a way that its rear frame element 21*c* side is thicker and front frame element 21*a* side is thinner. The front frame element 21*a* and rear frame element 21*c* are curved so that their center becomes higher, as shown in the front view FIG. 3(*d*). Grooveshaped multiple engagement concaves 23 are provided on the bottom face of the front frame element 21*a* as necessary. The lock member 25 is provided on a top face 28 side of the base frame. The lock member 25 has a base 26 formed at the top center of the rear frame element 21*c*, where the section from the top to rear face of the base 26 is finished into a rear curve 26*a*, with an engagement step 26*b* formed at the rear edge of the rear curve 26*a*. An arm 27 is provided at the front of the base 26, if necessary. The arm 27 has a tip 27*a* leading from a curved part 27*b* bending inward.

In this example, mounting holes 41, 41 are formed at the left and right corners of the front frame element 21*a*. These holes 41 are used to sew the wig clip at an edge of a wig, etc.

The base frame 2 is assembled to the projecting pins 22 in a manner axially joined to a comb body 3, which is explained later, in a rotatable manner, to constitute a wig clip 1. The comb body 3 is axially joined to the base frame 2 by passing through its opening 24 by intersecting with the side frame element 21*b*, where the rear element side of the comb body goes over the rear curve 26*a* of the lock member and contacts the rear frame element 21*c*, engaging with the engagement step 26*b* and eventually stopping. On the other hand, the top face of the comb tooth member constituting the front element side of the comb body 3 is present on a bottom face 29 side of the base frame, and when it engages with the engagement step 26*b* of the lock member 26, the top face of the comb tooth member is pushed up and pressed against the bottom face of the front frame element 21*a*. Preferably the bottom face of the frame member that contacts the comb tooth member is formed as an irregular or textured surface to prevent hair from slipping and also to facilitate gripping of hair. The arm 27 is curved in a manner making light contact with the base of the comb body, serving to tentatively stop the position of the comb body relative to the base frame.

<Comb Body>

Each of FIGS. 4(*a*), 4(*b*), 4(*c*), 4(*d*), and 4(*e*) shows an example of the comb body 3. FIG. 4(*a*) is a perspective view, FIG. 4(*b*) is a side view, FIG. 4(*c*) is a plan view, FIG. 4(*d*) is a front view, and FIG. 4(*e*) is a rear view.

The comb body 3 has a comb tooth member 31 at the front of a base 39 where shaft holes 34 are provided at the left and right edges, while a tab 33 is provided at the rear of the base 39 via a curved spring 32 that extends at an angle of elevation to the comb tooth member 31.

As shown in the front view FIG. 4(*d*), the base 39 is shaped in such a way that its center is curved upward, and the backs and edges of multiple comb tooth members 31, 31 . . . also form curved lines. The tab 33 at the rear is also curved. This curve is similar to the curve of the base frame and formed in such a way that when the two contact each other, their respective curves will match.

On the top face of the comb tooth member 31 extending from the base 39 toward the front, projections including base projections 36*c*, 36*c*, center projections 36*b*, 36*b* and a tip projection 36*a* are provided as necessary. The center projection 36*b* is provided in a manner corresponding to the groove-shaped engagement concave 23 provided in the front frame element 21*a* of the base frame 2, so that the two will engage with each other upon contact. These projections grip hair and serve as resistance to stabilize the fitting of the wig.

FIG. 6 shows an example of the comb tooth member 31 having a vertical projection 46 and lateral projection 47. The shapes and mounting directions of projections provided on the comb tooth member can be set as desired, such as lateral, vertical, and both lateral and vertical. Any desired shape, size or quantity can be selected.

When the arm 27 is provided for the base frame, a cutout 38 is formed at the center of the base 39 which will contact this arm 27, instead of providing the comb tooth member 31.

The curved spring 32 extending at an angle from the base 39 toward the rear adjusts the spring force by adjusting the angle of elevation as well as the size and thickness of a void 37 provided at the center. The curved interior surface of the curved spring 32 is formed to a size just large enough to retain the rear frame element 21*c* of the base frame, and when the tab 33 is pushed down and becomes engaged with the engagement step 26*b* of the lock member, the spring contracts and generates a reactive force to push up the comb tooth member 31 in front by using the base as the support shaft. The side of the void 37 in the tab 33 functions as an engagement receiver 35 and contacts the engagement step 26*b*. This reactive force causes the top face of the comb tooth member to contact the front frame element of the base frame to generate a clipping pressure.

In this example, mounting holes 42, 42 are formed in the left and right corners of the tab 33. These holes 42 can be used to attach the wig clip at an edge of a wig, etc.

It should be noted that the base 39 and the side frame element 21*b* of the base frame only need to be axially supported in a rotatable manner, which means that the relationship in the above example can be reversed because only one side needs to be a projection while the other side needs to be a concaved hole to receive the projection.

<Combination of Base Frame and Comb Body>

Each of FIGS. 1(*a*), 1(*b*), 1(*c*), 1(*d*), and 1(*e*) is an example of a wig clip in an open state. Each of FIGS. 2(*a*), 2(*b*), 2(*c*), 2(*d*), and 2(*e*) is an example of a wig clip in a closed state where the members are contacting each other. Each of FIGS. 1(*a*) and 2(*a*) is a perspective view, each of FIGS. 1(*b*) and 2(*b*) is a side view, each of FIGS. 1(*c*) and 2(*c*) is a plan view, each of FIGS. 1(*d*) and 2(*d*) is a front view, and each of FIGS. 1(*e*) and 2(*e*) is a rear view. Each of FIGS. 5(*a*) and 5(*b*) is a side view showing how a wig clip changes from an open state to a closed state.

Each of FIGS. 1(*a*), 1(*b*), 1(*c*), 1(*d*), and 1(*e*) illustrates an axially supported state where the comb body 3 is deflected and the shaft hole 34 is assembled with the projecting pin 22 on the base frame 2. In the side view of FIG. 1(*b*), the comb tooth member 31 and side frame element 21*b* are intersecting with each other and away from the front frame element 21*a*. The cutout 38 at the center of the base 39 of the comb body 3 is making light contact with the curved part 27*b* of the arm 27 of the lock member 25 to achieve a temporarily engaged state. The arm 27 is contacting the cutout 38 in FIGS. 1(*a*), 1(*c*), 1(*d*), and 1(*e*).

When the wig clip is inserted into the user's own hair in this state, hair enters the space between the comb body 31 and base frame 2.

The tab 33 of the comb body 33 is pushed in to cause the engagement receiver 35 to engage with the engagement step 26*b* of the lock member 25. When the inner side of the tab 33 contacts the engagement step 26*b* while sliding along the rear curve 26*a* of the lock member 25, a "click" sound is heard to confirm the end of clipping operation. This makes it easy for the wig user to remove/wear the wig on his/her own.

As shown in FIG. 2(*d*), the curved surfaces are firmly contacting each other when the comb tooth member 31 and base frame 2 are contacting each other. Since the center is curved upward, hair trapped in between is guided toward the center and stability improves.

Each of FIGS. 5(*a*) and 5(*b*) shows how the position changes from FIG. 5(*a*) (an open state) to FIG. 5(*b*) (a closed state). The comb body 3 is axially connected to the projecting pins 22 of the base frame 2. FIG. 5(*a*) shows how the tab 33 connected to the curved spring 32 of the comb tooth body slides toward the engagement step 26*b* along the rear face 26*a* of the lock member 25. In FIG. 5(*b*), the tab 33 is engaged with the engagement step 26*b* and locked. The curved springs 32 provided on both sides of the void 37 are contracting, and the multiple comb teeth 31 are pressed against the bottom face of the front frame element 21*a* via the pins 22, which are the support shafts, as fulcrums. The center projections 36*b*, 36*b* provided on the comb teeth 31 enter the groove-shaped engagement concaves 23 provided in the bottom face of the front frame element 21*a*. The base projections 36*c*, 36*c* are positioned at the opening 24 in the frame member 21, while the tip projection 36*a* is positioned at the front of the front frame element 21*a*.

When hair is clipped in the position of FIG. 5(*b*), the force of the curved spring 32 causes hair to be clipped strongly and also held by the projections (36*a*, 36*b*, 36*c*) under a strong anti-release force. Also, the facing surfaces of the base frame and comb tooth member can be given a textured surface to increase resistance to prevent hair from slipping out.

The user can easily identify the clipping surface by the roughness of these opposing textured surfaces and also by the projections (36*a*, 36*b*, 36*c*) and engagement concaves 23.

To release the clipping state, the tab is pulled up while holding down the top face of the lock member to release the lock. Of course the wig clip can be used again to wear the wig, allowing the user to wear and remove the wig freely.

This example is a wig clip manufactured using polyacetal resin (POM). Instead of a reversing force of metal, elastic deformation force of synthetic resin is used to form a curved spring and when this curved spring contracts and locks, a clipping force is generated. When a metal detector test was conducted with subjects wearing on their head a wig to which these clips were attached as shown in FIG. 8, the subjects could pass through the metal detector without being detected. This means that the user can go in and out of airport security checks, immigration counters and important facilities with peace of mind. The wig in this example is much lighter than its metal counterpart and generates no discomfort. In the case of a partial head accessory such as hairpiece, heavy metal clips can make the artificial hair move unnaturally, which necessitates other ingenious ways to wear a hairpiece. On the other hand, the wig clip in this example moves in synchronization with the surrounding hair, eliminating unnaturalness and improving flexibility. As a result, the wig user feels secure at all times and the user's quality of daily life improves.

The wig clip in this example also allows patients suffering from metal allergy to use a wig, meaning that they can receive tests and treatments at hospitals while wearing their wig.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, an article "a" may refer to a species or a genus including multiple species, and "the invention" or "the present invention" may refer to at least one of the embodiments or aspects explicitly, necessarily, or inherently disclosed herein. In this disclosure, any defined meanings do not necessarily exclude ordinary and customary meanings in some embodiments.

The present application claims priority to Japanese Patent Application No. 2012-048671, filed Mar. 6, 2012, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A wig clip constituted by a plastic base frame and plastic comb body, wherein:

the base frame has pins or holes provided on/in side elements of a rectangular frame member comprising front and rear elements and the side elements;

the comb body has a base and multiple comb teeth provided at the front of the base, while a tab is provided at the rear of the base via a spring having a void, with holes or pins formed in/on the left side and right side of the base;

the comb body and the base frame are axially joined in a rotatable manner and the positions of the two can be changed between an open state and a clipping state using a lock mechanism;

the comb teeth and a spring provided on the comb body are bent at the base;

the spring is curved and connected to the tab, while the size of an inner curved space at the curved part is such that it spans across the rear element of the base frame; and the base frame and the comb body are locked in a clipping state by operating the tab, and unlocked via opening operation.

2. A wig clip according to claim 1, wherein the lock mechanism has a step formed on the rear element of the frame member of the base frame and is constituted by engagement of the step with the tab provided on the comb body.

3. A wig clip according to claim 1, wherein the front and rear elements of the base frame are gradually curved and the comb body is also curved along the curve of the base frame, with the two members forming a clipping state where both are contacting each other.

4. A wig clip according to claim 1, wherein the comb tooth members of the comb body have projections formed on their top face and/or side face.

5. A wig clip according to claim 1, wherein a concave for engagement is formed on a back face of the front element of the base frame, while a projection is formed on a top face of the comb tooth, with the engagement concave engaging with the engagement projection in a clipping state.

6. A wig clip according to claim 1, wherein the lock member formed on the rear element of the base frame has an arm curving toward a front inner side, in order to contact the base of the comb body and generate turning resistance when turned toward an open state, thereby functioning to maintain the position in the open state.

7. A wig clip according to claim 1, wherein the side element of the base frame is formed in a manner that its rear element side is thick and its front element side is thin relative to each other.

8. A wig clip according to claim 1, wherein a back face of the front element of the base frame and a top face of the comb tooth of the comb body have a textured surface.

9. A wig clip according to claim 1, wherein wig attachment holes are formed in the tab of the comb body and the front element of the base frame.

10. A wig product and hair accessory on which wig clips according to claim 1 are attached.

* * * * *